United States Patent [19]

Berrebi et al.

[11] Patent Number: 4,986,424

[45] Date of Patent: Jan. 22, 1991

[54] PROCESS AND APPARATUS FOR SEPARTING MATERIALS OF DIFFERENT SHAPES OR SIZES

[75] Inventors: Georges Berrebi, Bourg Les Valence; Francois Ackermann, La Voulte Sur Rhone, both of France

[73] Assignee: Europeenne de Retraitement, La Voulte Sur Rhone, France

[21] Appl. No.: 481,687

[22] Filed: Feb. 20, 1990

Related U.S. Application Data

[63] Continuation of Ser. No. 922,491, Oct. 23, 1986, abandoned.

[30] Foreign Application Priority Data

Oct. 23, 1985 [FR] France ..... 85 15947

[51] Int. Cl.[5] ..... B07C 9/00

[52] U.S. Cl. ..... 209/691; 209/434; 209/459

[58] Field of Search ..... 209/697, 434, 479, 481, 209/459, 694, 691, 700, 436, 707

[56] References Cited

U.S. PATENT DOCUMENTS

| | | | |
|---|---|---|---|
| 1,044,067 | 11/1912 | McKesson et al. | 209/694 |
| 2,778,498 | 1/1957 | Vincent | 209/694 |
| 2,875,895 | 3/1959 | Traylor | 209/694 |
| 2,936,072 | 5/1960 | Gray | 209/434 |
| 2,974,799 | 3/1961 | Gray | 209/434 |
| 3,085,070 | 4/1963 | Fowle et al. | 252/420 |
| 3,464,550 | 9/1969 | Bieler et al. | 209/69 X |
| 3,672,500 | 6/1972 | Hayes | 209/695 |
| 3,743,093 | 7/1973 | Klancnik | 209/920 X |
| 4,009,783 | 3/1977 | Park | 209/700 X |
| 4,022,638 | 5/1977 | Weet | 209/10 X |
| 4,070,274 | 1/1978 | Bryson | 209/10 |
| 4,295,569 | 10/1981 | Niederer | 209/700 X |
| 4,535,893 | 8/1985 | Bühren | 209/920 X |
| 4,583,645 | 4/1986 | Yamamoto | 209/69 X |

FOREIGN PATENT DOCUMENTS

| | | | |
|---|---|---|---|
| 568010 | 6/1923 | France | 209/694 |
| 2108871 | 11/1982 | United Kingdom . | |

*Primary Examiner*—Donald T. Hajec

*Attorney, Agent, or Firm*—White & Zelano Millen

[57] ABSTRACT

The invention concerns a process and an apparatus for separating powdery materials shaped as balls or pellets. It is characterized by the use of a vibrating screw elevator (4) subjected to vibrations of an amplitude so selected as to produce on the screw turns (5), an upward flow of the particles to be removed, while maintaining a downward flow of the particles to be recovered. The invention provides in particular for the separation of round balls from broken balls.

2 Claims, 1 Drawing Sheet

PROCESS AND APPARATUS FOR SEPARTING MATERIALS OF DIFFERENT SHAPES OR SIZES

This application is a continuation of application Ser. No. 06/922,491, filed Oct. 23, 1986, now abandoned.

The invention concerns a vibrating screw elevator and its use for efficiently separating spherical particles from non spherical particles, for example for separating round balls from broken balls of substantially the same size.

This apparatus, eventually associated with a screen separator, is particularly useful for refiners and petrochemists by providing them a way of recovering lots of perfectly calibrated inert balls.

But the apparatus according to the invention can be used for other applications, for example for separating grains from shells in food-agricultural industries or for separating catalysts particles of spherical shape from badly shaped spheres.

More generally the apparatus provides for the separation of spherical materials of different sizes as well as the separation of spheres from sphere fragments herinafter called "chips".

The system according to the invention provides for the removal of chips from a mixture of spherical or ovoid products and to remove broken ceramic balls from beds of inert balls placed in hydrotreatment reactors, in the refining industry, thus making it possible to recover, after sorting, a lot of perfectly calibrated inert balls which can be reused with the same efficiency as fresh material.

SUMMARY OF THE INVENTION

The apparatus according to the invention is of the vibrating screw elevator type. It is formed of at least one spiral (or helix) of substantially vertical axis whose slope is about 2 to 20 degrees, preferably 9 to 16 degrees. The width of the path within the spiral is e.g. from about 50 to 400 mm, preferably from 200 to 300 mm, with a pitch (distance between the edges of two successive turns) from e.g. 50 to 150 mm, preferably 80 to 120 mm, e.g. about 100 mm.

The screw, or each screw, when the apparatus has several screws, comprises 2 to 9 turns or more, for example up to 150 turns of a spiral wound e.g. about a hollow shaft, the bottom or the top of which are associated for example with devices for imparting to the shaft-spiral assembly a vibrational motion of variable amplitude.

The vibrations may be produced by a system placed at any adequate level, for example at the bottom or the top of the hollow shaft or still about the spiral. Examples of suitable systems are, for example: imbalance motors, electro-magnetic vibrating systems (excited by a variable cycle, with pulse generation) and imbalance exciters. The (lateral) amplitude of the vibrational motion thus imparted to the assembly (lateral displacement of the shaft vertical walls) may thus range from 0.2 to 15 mm, preferably from 2 to 5.5 mm. The shaft-spiral assembly, source of vibration, may be placed, for example, on a central pillar used as support, various antivibrational materials being optionally interposed between the shaft and the pillar. The material of which is made the spiral, more exactly the turns of the spiral, may be a sanded soft steel, or a stainless steel etc . . . , coated with an antirust paint. By modifying the coating of the turns, i.e. for example by application of a plastic paint or by sticking of a rubber strip or any other convenient material, it is possible not only to change the adhesion coefficient and, consequently, the segregation rate of the materials for a given amplitude, but also to considerably reduce the noise generated by the balls motion on the steel.

BRIEF DESCRIPTION OF THE DRAWINGS

The invention is illustrated by the accompanying drawings wherein:

As shown in FIG. 1, the screw elevator comprises a central shaft (7) with a spiral (4) having 5 turns, such as (5).

The imbalance motor (6) generates vibrations about the shaft.

The flow of mixed balls or balls with chips to be separated (cereals, refractory ceramics, pills used in pharmacy, confectionery, catalysts, etc . . ) is introduced through line 1 at the periphery of the spiral, in a turn intermediate between the upper and the lower turn, for example at half-height of the spiral and preferably in a turn between the lower turn and a turn substantially at mid-height thereof.

The solid particles will thus circulate on the spiral strip or the conveying strip of the turn, each conveying strip being defined between the internal and external edges of each turn.

The vibration system is adjusted, essentially in accordance with the size and the amount of particles to be separated, i.e. of their rate of introduction in the turn, in order to obtain the desired separation. At the vicinity of the turn of introduction of the solids, a rather confuse circulation of balls and chips mixtures is observed involving a beginning downward flow of all particles, the smaller particles being driven along with the larger ones, but then, unexpectedly, the smaller particles or chips initiate an upward flow, mainly along the inner half of the conveying strip of each turn, counter-currently with the larger balls which flow downwardly along the turn at an increasing velocity, so that, by centrifugal acceleration, the large balls roll more and more at the periphery of the turn, i.e. mainly along the outer half of the conveying strip of each turn.

Consequently, progressively and without interference, the balls flow down along the outer edges of the spiral turns countercurrently with the small balls or chips which flow upwardly along the internal edges of the spiral turns.

The vibration system is conveniently adjusted in accordance with the nature and size of the particles to be withdrawn.

Figure 1:
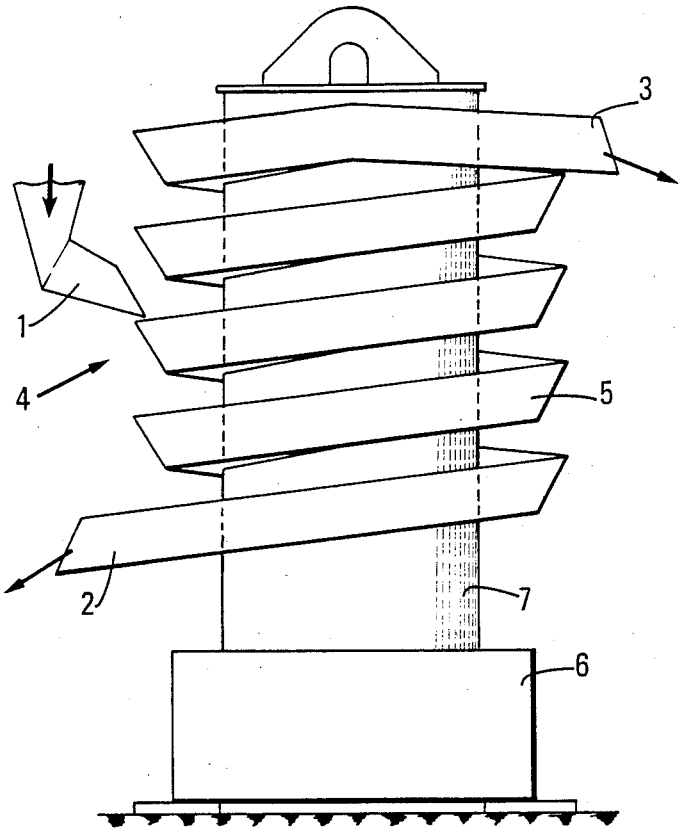
FIG. 1 is a side elevation view of a screw elevator according to the invention.
Figure 2:
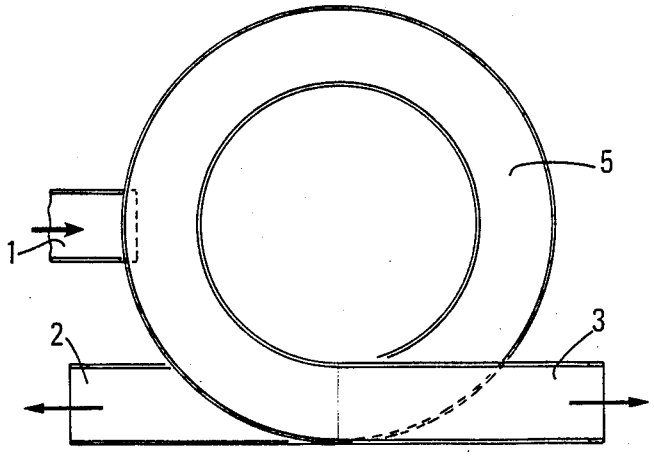
FIG. 2 is a top view of the apparatus of FIG. 1.

According to FIG. 1, the small balls or chips are discharged from the top through line 3, the balls of desired size being recovered through line 2, at the spiral bottom. This is shown also in the top view of FIG. 2.

EXAMPLE

The following example is given to illustrate the invention but must not be considered in any way as limiting the scope thereof.

Separation tests have been conducted with mixtures of solid particles:

The mixture fed through line 1 of FIG. 1 was formed of 3 types of particles:

balls of about 1 inch diameter, each ball weighing about 21.3 g.

balls of about ½ inch diameter, each ball weighing about 5.2 g.

chips whose weight, depending on their size, ranges from 0.5 to 15 g.

Each of these 3 types of particles represents ⅓ by volume of the total mixture.

The spiral of the screw had 4.5 turns of 10 cm pitch. The width of the strip was 30 cm and the slope 6.5 degrees. The mixture was fed at a level between the second and third turns from the bottom.

In a first test, the amplitude of the vibrations was adjusted to 2 mm. As observed, the chips were subjected to a vibrational motion such that, by successive micro-kicks on the turn strip, they rise in the spiral and are discharged therefrom through line 3, whereas balls 1 or ½ inch diameter flow downwardly or remain in the lower part of the spiral and are finally discharged through line 2.

In a second test, the amplitude of the vibrations was adjusted to 3.5 mm. Here, the balls of ½ inch diameter also rise with the chips so that only the balls of 1 inch diameter are discharged through line 2.

Other tests performed with balls of ¼, ½, ¾, 1 and 2 inches diameter and with chips of different particle sizes show that it is possible, by selecting the proper amplitude, to separate spherical or ovoid particles from particles comprising one or more plane faces, with minimum yields of 95 to 98% and mostly of 99 to 100%.

What is claimed as the invention is:

1. A process for fractioning a mixture of relatively large balls having a diameter of approximately 25 mm and a weight of approximately 21 g, relatively small balls having a diameter of approximately 12 mm and a weight of approximately 5 g, and solid chips having a weight in the range of 0.5 g to 15 g, the process comprising the steps of:

providing a spiral ramp coated with a non-metallic material, the ramp having a width in the range of 50 to 400 mm, a slope in the range of 2° to 20°, and a between two turns in the range of 50 to 150 mm, the spiral ramp having a top exit and a bottom exit with the intermediate location therebetween;

feeding the mixture at an intermediate location on the spiral ramp;

advancing the relatively large balls down the spiral ramp to dispense therefrom at the bottom exit while advancing the chips and relatively small balls up the ramp to dispense therefrom at the top exit by applying a lateral vibration having a lateral amplitude in the range of 0.2 to 15 mm.

2. The process of claim 1, wherein the chips and small balls advance up the ramp when the lateral vibration has an amplitude of about 3.5 mm with the spiral ramp having about 4.5 turns at a pitch of about 10 cm, a slope of about 6.5 degrees and a with of about 30 cm, the mixture being dispensed onto the spiral ramp at a location between the second and third turns from the bottom exit of the spiral ramp.

* * * * *